US010875612B1

(12) United States Patent
Way

(10) Patent No.: US 10,875,612 B1
(45) Date of Patent: Dec. 29, 2020

(54) DOCK ASSEMBLY AND METHOD OF CONSTRUCTION THEREOF

(71) Applicant: CRESCENT EQUIPMENT COMPANY, Crescent, GA (US)

(72) Inventor: Robert Way, Townsend, GA (US)

(73) Assignee: CRESCENT EQUIPMENT COMPANY, Crescent, GA (US)

( * ) Notice: Subject to any disclaimer, the term of this patent is extended or adjusted under 35 U.S.C. 154(b) by 161 days.

(21) Appl. No.: 16/201,075

(22) Filed: Nov. 27, 2018

Related U.S. Application Data

(60) Provisional application No. 62/590,719, filed on Nov. 27, 2017.

(51) Int. Cl.
*B63C 1/02* (2006.01)

(52) U.S. Cl.
CPC ..... *B63C 1/02* (2013.01)

(58) Field of Classification Search
CPC ..... B63C 1/02
See application file for complete search history.

(56) References Cited

U.S. PATENT DOCUMENTS 4,928,617 A * 5/1990 Meriwether ..... B63B 35/38 114/263
5,743,205 A * 4/1998 Morris ..... B63B 35/34 114/266
7,314,017 B2 * 1/2008 Moore ..... B63B 35/34 114/263
8,166,901 B2 * 5/2012 Gerst ..... B63B 35/38 114/263
8,955,449 B2 * 2/2015 Falcone ..... B63B 35/38 114/263
2004/0018054 A1 * 1/2004 Rueckert ..... B63C 1/02 405/7
2005/0172876 A1 * 8/2005 Ostreng ..... B63C 1/02 114/45
2005/0204989 A1 * 9/2005 Ahern ..... B63C 1/02 114/266
2014/0248083 A1 * 9/2014 Imel ..... B63C 3/06 405/3
2015/0307170 A1 * 10/2015 Wittenberg ..... B28B 23/0056 114/263
2016/0214683 A1 * 7/2016 Simola ..... B63B 35/38
2016/0281770 A1 * 9/2016 Vankoughnett ..... E02B 3/064
2016/0347430 A1 * 12/2016 Allen ..... B63B 35/38

* cited by examiner

*Primary Examiner* — Lars A Olson
*Assistant Examiner* — Jovon E Hayes
(74) *Attorney, Agent, or Firm* — Allen Dyer Doppelt & Gilchrist, PA

(57) ABSTRACT

A dock assembly includes a first and a second dock sidewall joined via a first vertical receiver tube positioned between adjacent ends of the first dock sidewall and the second dock sidewall. A third dock sidewall is joined with the second dock sidewall via a second vertical receiver tube positioned between adjacent ends of the second dock sidewall and the third dock sidewall. A fourth and a fifth dock sidewalls are joined via a third vertical receiver tube positioned between adjacent ends of the fourth dock sidewall and the fifth dock sidewall. The second and the fifth dock sidewalls are positioned side by side such that respective sides of the first and third receiver tubes are abutting each other. The first and third receiver tubes are securely joined by inserting respective upper and lower connector keys dimensioned to fit into respective sockets of the first and third receiver tubes.

20 Claims, 10 Drawing Sheets

DOCK ASSEMBLY AND METHOD OF CONSTRUCTION THEREOF

CROSS-REFERENCE TO RELATED APPLICATION

This application claims the benefit of U.S. Provisional Patent Application Ser. No. 62/590,719, filed on Nov. 27, 2017, the contents of which applications are herein incorporated by reference in their entirety.

FIELD OF THE INVENTION

The present invention relates to a dock assembly, and more particularly, to a floating dock assembly and method of construction thereof.

BACKGROUND OF THE INVENTION

A common way of connecting floating dock assemblies is to install connection hardware from below and underneath the dock sections to be connected. Another way of connecting floating dock assemblies involves partial disassembly of deck components to allow access to fastener locations at the ends of the dock. Docks of wood construction allow for easy removal and/or replacement of deck boards, whereas aluminum docks with aluminum deck planks welded into the sidewall do not easily accommodate deck disassembly.

A common approach to connecting floating dock structures requires an installer in the water equipped with wrenches to assemble the connection hardware from under the dock. The small clearance of a typical dock freeboard elevation makes connection difficult or impossible for one person. This is because one hand is needed to keep the person afloat, leaving only one hand available for work. This difficulty can foster complacency and a disregard for best practices. The installer might not connect hardware properly or might omit some parts entirely.

In rough water conditions, the frame sidewalls can undergo extreme cyclic loads. The result can be brinelling of the aluminum at an attachment site, if metal hardware is used to connect metal (e.g., aluminum) docks in a conventional manner. Moreover, if the sidewall is deformed underneath the fastener, further degradation will be inevitable, resulting in loss of the connection clamp load. Floating concrete docks are prone to connection failure due to the compressibility of the wooden whaler used to sandwich the concrete floatation cells together. Regular, routine maintenance is essential.

A multiple floating dock installation generally requires a maintenance plan. This will involve periodic checks of the tightness of dock connections. Often, however, a scheduled maintenance plan is ignored, turning maintenance into repair, though usually only after a connection-related failure has occurred. Further improvements on affixing aluminum docks to one another are possible.

Installing multiple floating dock assemblies is a considerable undertaking when they are floating in water. Further improvement on the docking connection is possible.

SUMMARY OF THE INVENTION

In view of the foregoing, it is an object of the present invention to provide a dock assembly and method of constructing the dock assembly.

According to one embodiment of the present invention, a dock assembly includes a first dock sidewall and a second dock sidewall joined via a first vertical receiver tube positioned between adjacent ends of the first dock sidewall and the second dock sidewall. A third dock sidewall is joined with the second dock sidewall via a second vertical receiver tube positioned between adjacent ends of the second dock sidewall and the third dock sidewall. A fourth dock sidewall and a fifth dock sidewall are joined via a third vertical receiver tube positioned between adjacent ends of the fourth dock sidewall and the fifth dock sidewall. The second dock sidewall and the fifth dock sidewall are positioned side by side such that respective sides of the first and third receiver tubes are abutting each other. The first and third receiver tubes are securely joined by inserting respective upper and lower connector keys dimensioned to fit into respective sockets of the first and third receiver tubes.

According to another embodiment of the present invention, a dock connection adapter is configured to be connected to a dock sidewall. The connection adapter having an elongated middle member and two receiver tubes positioned on two ends of the elongated middle member.

According to another embodiment of the present invention, a method of constructing a docking system includes securely fixing a first and a second dock sidewall to a first vertical receiver tube. The second and a third dock sidewall are securely fixed to a second vertical receiver tube. A fourth dock sidewall and a fifth dock sidewall are securely fixed to a third vertical receiver tube. The second dock sidewall and the fifth dock sidewall are positioned side by side such that the first and fourth sidewalls are in alignment and the respective sides of the first and third receiver tubes are abutting each other. The first and third receiver tubes are securely joined by inserting respective upper and lower connector keys dimensioned to fit into respective sockets of the receiver tubes. A plurality of lock bolts and a plurality of matching nuts are installed to secure the upper and lower connector keys onto the first and third receiver tubes respectively.

These and other objects, aspects and advantages of the present invention will be better appreciated in view of the drawings and following detailed description of preferred embodiments.

DETAILED DESCRIPTION OF PREFERRED EMBODIMENTS

Figure 1:
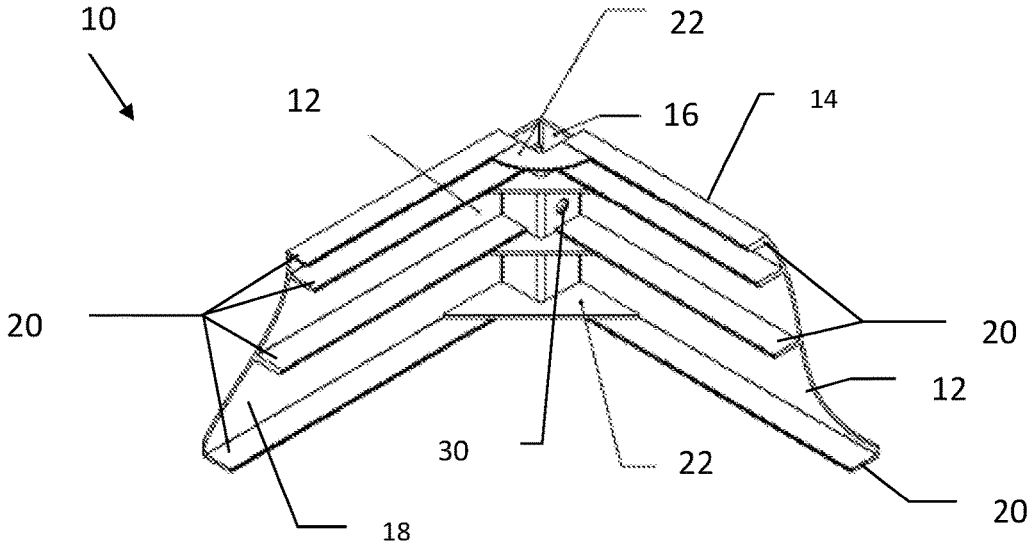
FIG. 1 is a perspective view of a portion of a dock assembly according to an embodiment of the present invention.
Figure 2:
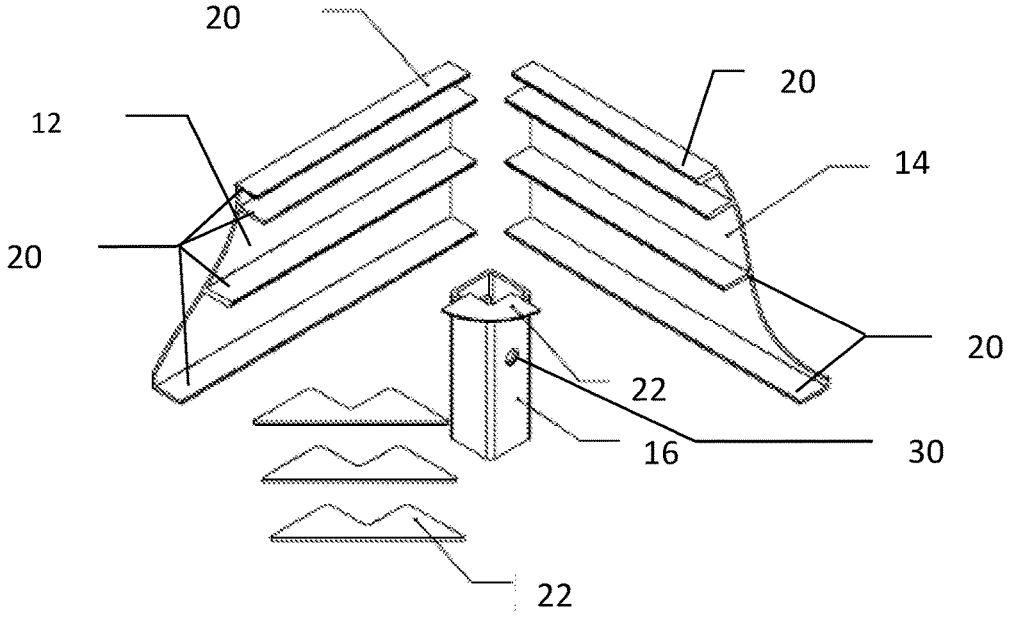
FIG. 2 is an exploded perspective view of a portion of the dock system of FIG. 1.
Figure 3:
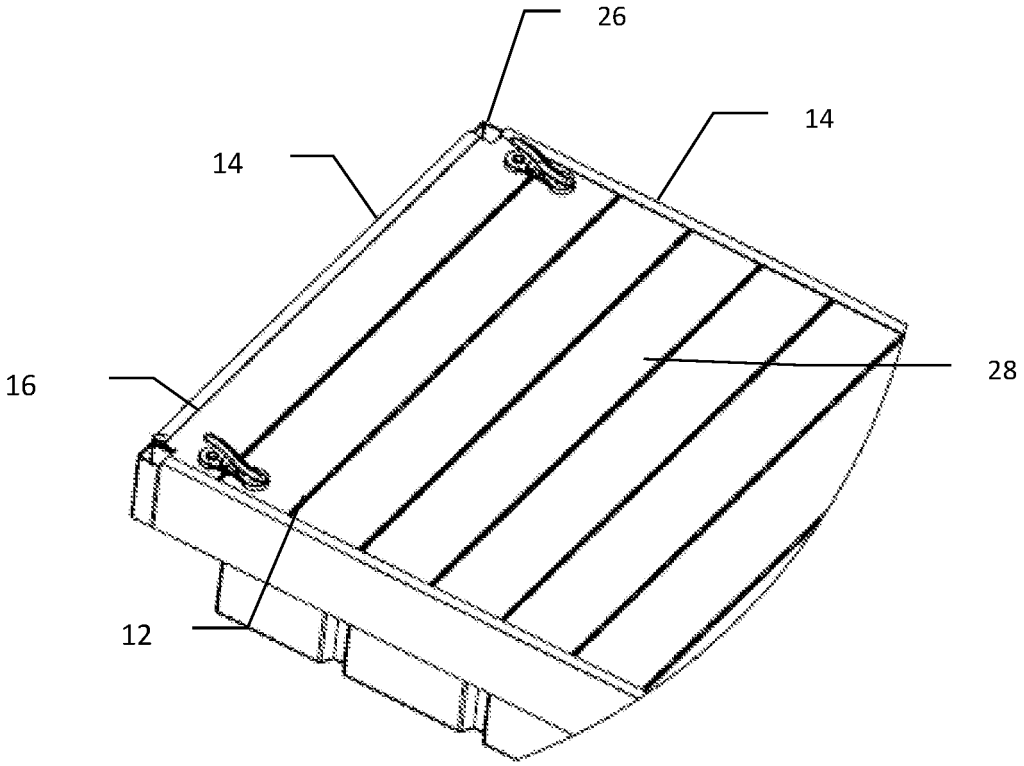
FIG. 3 is a perspective view of a dock assembly according to another embodiment of the present invention.
Figure 4:
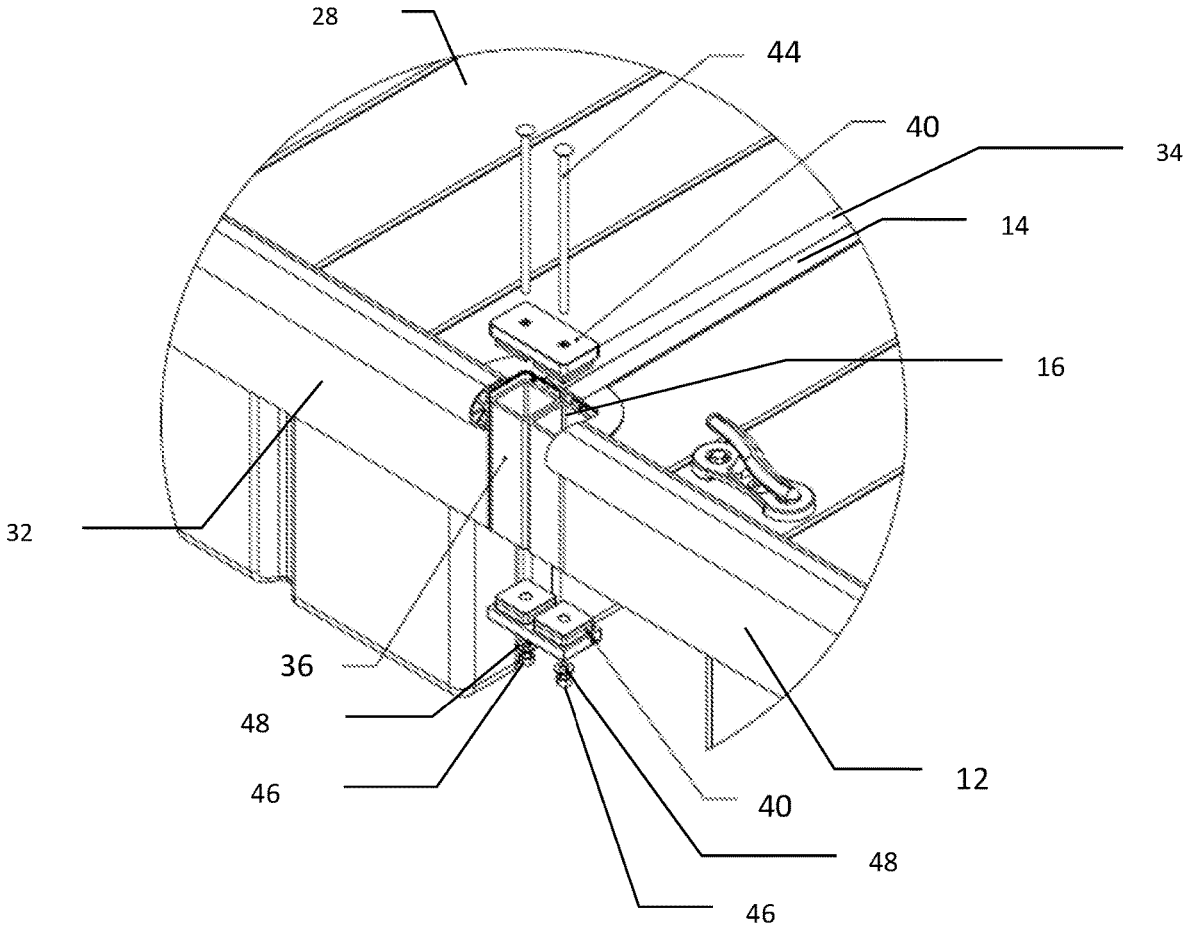
FIG. 4 is an exploded perspective view of another dock assembly according to another embodiment of the present invention.
Figure 5:
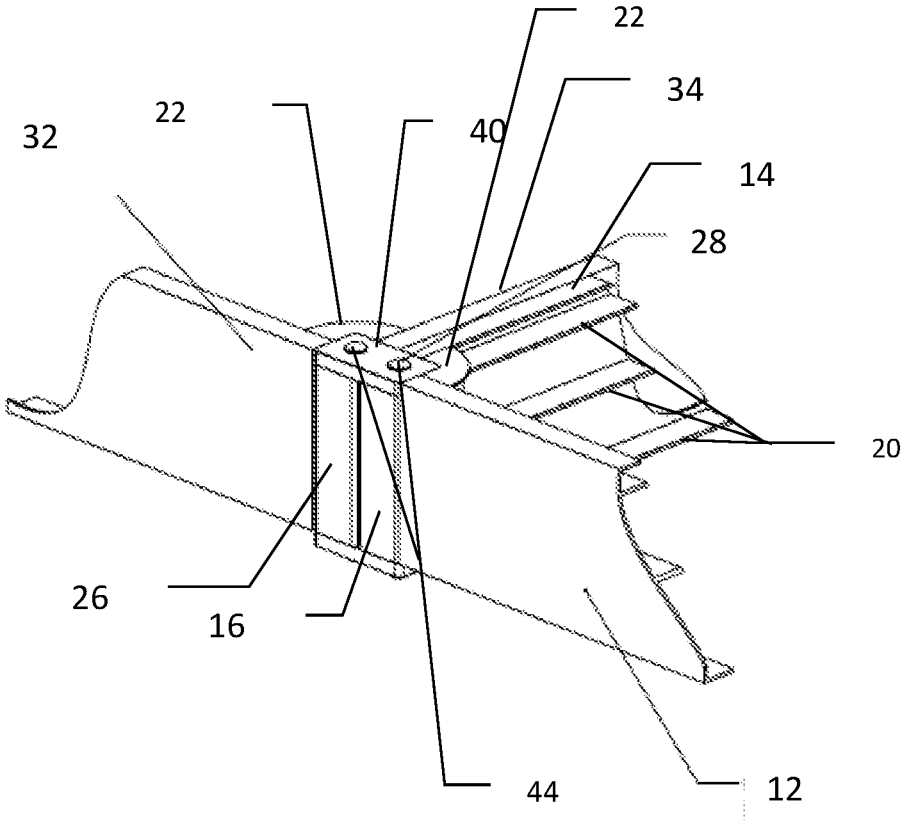
FIG. 5 is a perspective view of the dock assembly of FIG. 4.
Figure 6:
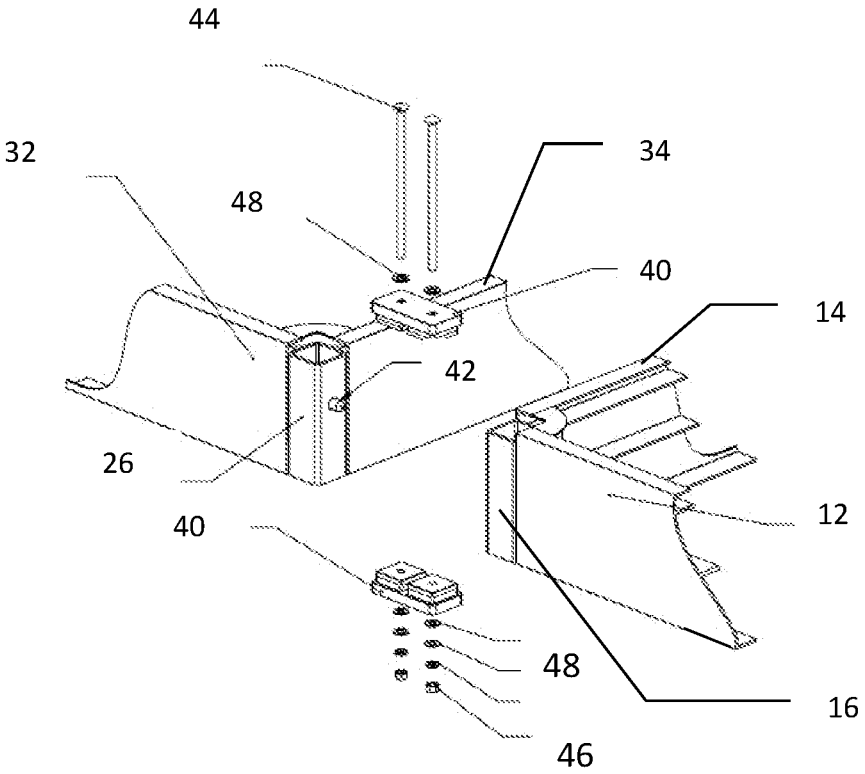
FIG. 6 is another exploded perspective view of the dock assembly of FIG. 4.

Referring to FIGS. 1-2, a dock assembly 10 includes a first dock sidewall 12 and a second dock sidewall 14 joined at 90 degrees via a first vertical receiver tube 16 positioned between adjacent ends of the first dock sidewall 12 and the second dock sidewall 14. The first and second dock sidewalls 12 and 14 each includes a peripheral surface 18 and a plurality of horizontal surfaces 20 extending from the peripheral surface 18. The first and second dock sidewall 12 and 14 are fixed to the first vertical receiver tube 16 via a first set of gusset plates 22 fastened to the plurality of horizontal surfaces 20 of the first dock sidewall 12 and the second dock sidewall 14, respectively.

The first set of gusset plates 22 includes a top gusset plate configured to be positioned at an upper periphery of the first receiver tube 16 and attached to an upper horizontal surface 20. The rest of the first set of gusset plates 22 are attached to the lower horizontal surfaces 20 of the first and second dock sidewalls 12 and 14. As an example, the first set of gusset plates 22 can be welded to the plurality of horizontal extending planar surfaces 20 on the respective first and second sidewalls 12 and 14. Other types of fastening means can be used.

The assembly 10 further includes a third dock sidewall 24 joined at a 90-degree angle with the second dock sidewall 14 via a second vertical receiver tube 26 positioned between adjacent ends of the second dock sidewall 14 and the third dock sidewall 24. The third dock sidewall 24 also includes a peripheral surface 18 and a plurality of horizontal surfaces 20 extending from the peripheral surface. Similar to the joining of the first and second dock sidewalls 12 and 14, the second and third dock sidewalls 14 and 24 are fixed to the second vertical receiver tube 26 via a second set of horizontals gussets (not shown) attachable to the plurality of horizontal surfaces (not shown) of the second dock sidewalls 14 and the third dock sidewall 24, respectively. A plurality of deck boards 28 are positioned in parallel between the first and third dock sidewalls 14 and 24.

Referring to FIGS. 4-7, the dock assembly 10 further includes a fourth dock sidewall 32 and a fifth dock sidewall 34 joined at a 90-degree angle via a third vertical receiver tube 36 positioned between adjacent ends of the fourth dock sidewall 32 and the fifth dock sidewall 34 respectively. Similar to the first, second and third sidewalls 12, 14 and 24, the fourth and fifth dock sidewalls 32 and 34 each includes a peripheral surface 18 and a plurality of horizontal surfaces 20 extending from the peripheral surface. The fourth and fifth dock sidewalls 32 and 34 are fixed to the third vertical receiver tube 36 via a third set of gusset plates (not shown) fastened to the plurality of horizontal surfaces of the fourth dock sidewall 32 and the fifth dock sidewall 34 respectively. The second dock sidewall 14 and the fifth dock sidewall 34 are positioned side by side such that the first and fourth sidewalls 12 and 32 are in alignment and the respective sides of the first and third receiver tubes 16 and 36 are abutting each other. The first and third receiver tubes 16 and 36 are securely joined by inserting respective upper and lower connector keys 40 dimensioned to fit into respective sockets of the receiver tubes 16 and 36. The upper and lower connector keys 40 can also be chamfered to aid installation.

The first and third abutting receiver tubes 16 and 36 are further securely joined via a horizontally-positioned alignment pin 42 on a side wall of the first receiver tube 16 and a complimentary opening 30 on the third receiver tube 36 configured to receive the alignment pin 42. The alignment pin 42 is preferably made of aluminum but other types of metal can be used instead. The alignment pin 42 strengthens the connection between two sections of a dock assembly.

In the depicted embodiment, the receiver tubes (e.g., receiver tubes 16 and 36) are hollow and have a square cross section. Other shapes of cross section can be used. The sidewalls are preferably made of aluminum, but other metals or suitable materials can also be used.

Figure 7:
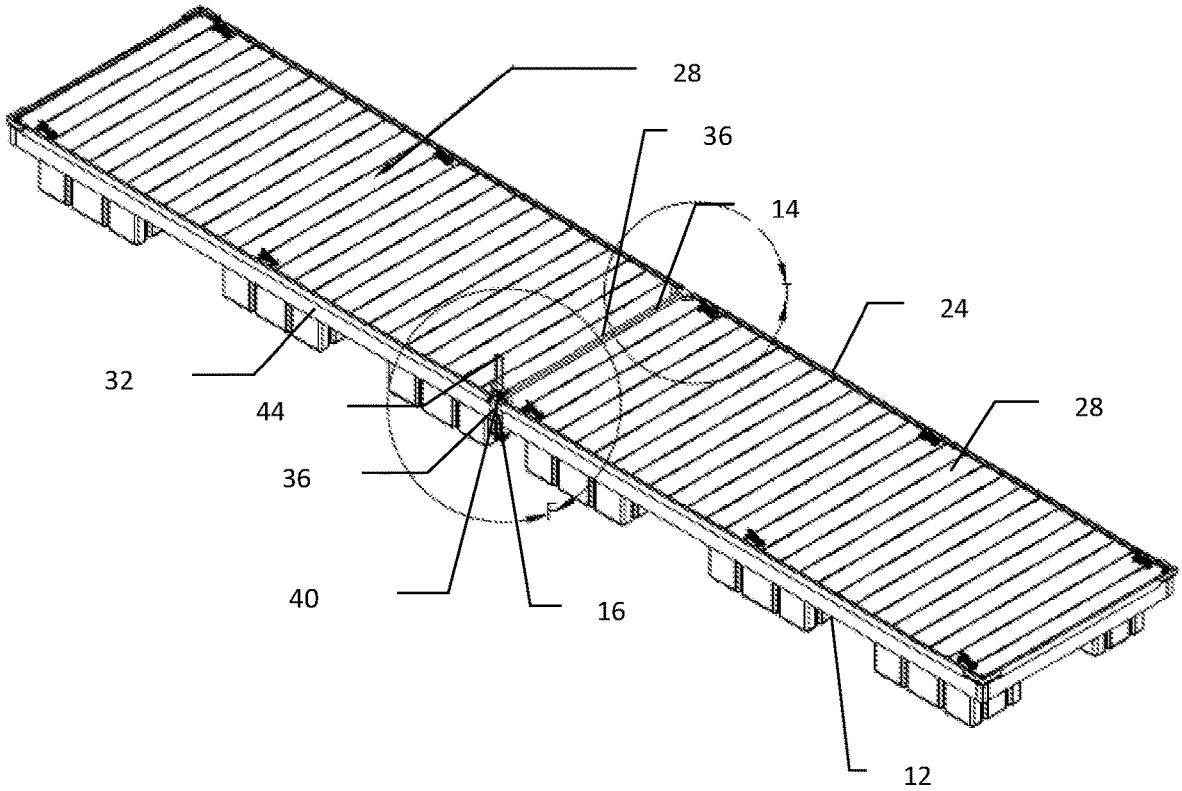
FIG. 7 is a perspective view of a dock assembly.
Figure 8:
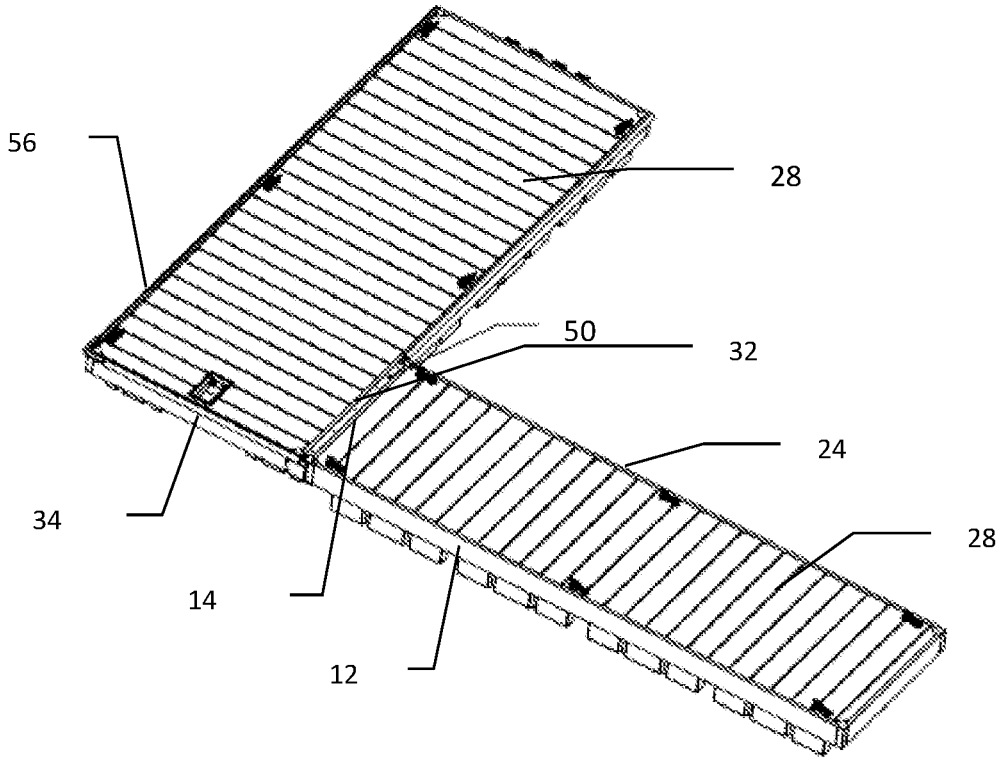
FIG. 8 is a perspective view of a L-shaped docks assembly.
Figure 9:
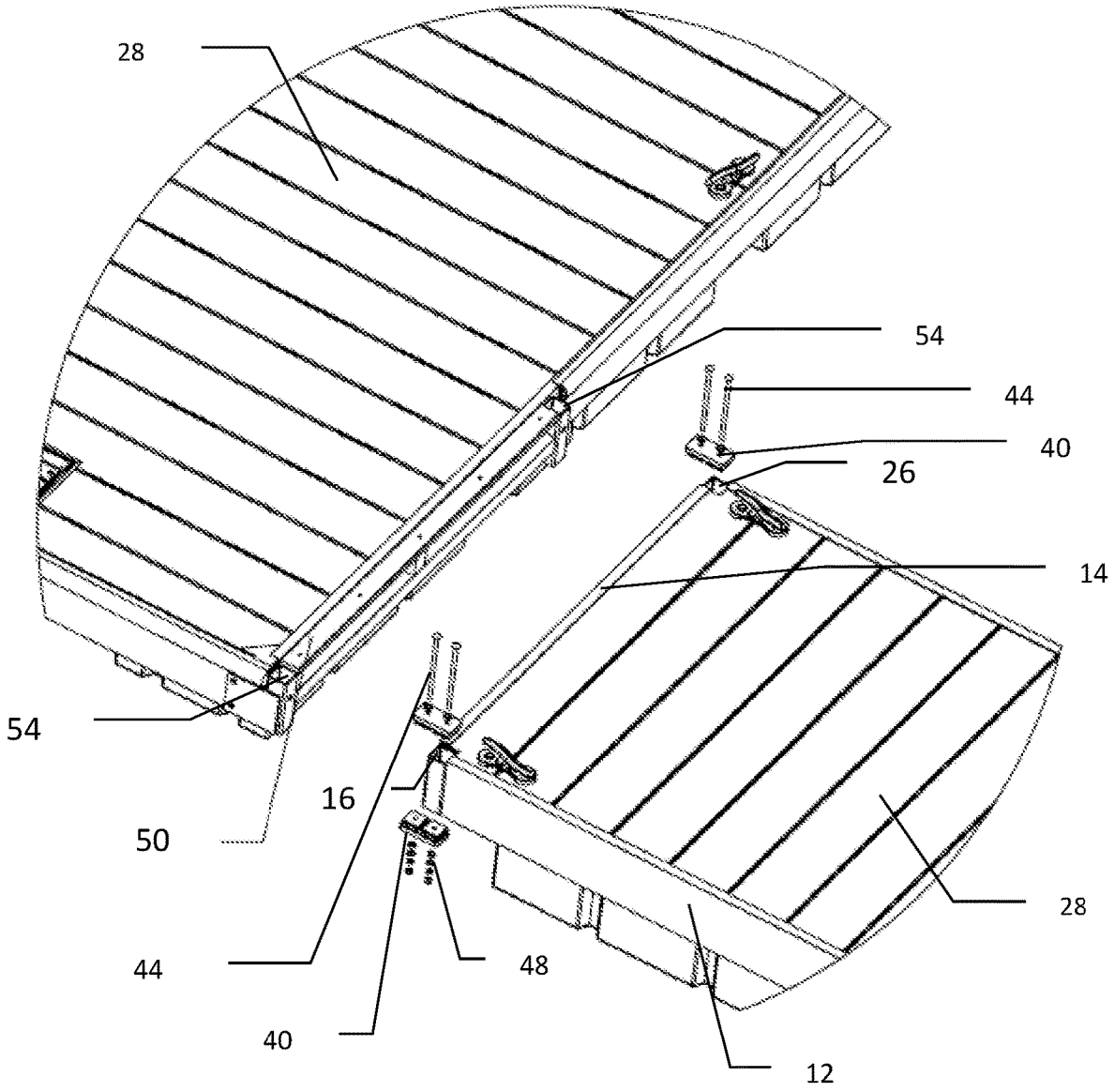
FIG. 9 is an exploded perspective view of the dock system of FIG. 7.

A plurality of lock bolts 44 (e.g., carriage head square neck bolts) and associated hardware are used to secure upper and lower connector keys 40 onto the respective receiver tubes 16 and 36. The plurality of lock bolts 44 are installed with the round head facing upwards to reduce the surface profile. Once the lock bolts 44 and associated hardware are installed, respective nuts 46 on the bottom of the lock bolts 44 can be tightened gradually while tapping the connector keys 40 with a dead blow hammer and alternating back and forth from one fastener to another during the tightening process. The respective nuts 46 can be installed after applying anti-seize lubricant. The respective nuts 46 can be tightened to an appropriate torque, e.g. 37 ft-lbs. If the torque value is reached before the connector key 40 is drawn fully into the respective receiver tube, the nut 46 can also be backed off a few turns, the upper and lower connector keys 40 can be tapped with a dead blow hammer, and nut 46 can be re-torqued. FIG. 7 shows two docking units connected end to end to achieve a longer docking assembly.

The hardware used under the lock head of the lock bolts 44 and between the nuts 46 and the lower connector key 40 can also include one or more plastic washers 48 (e.g., nylon washer, split washer, etc.) placed between any stainless parts and the aluminum or other parts to prevent electrolysis or galvanic degradation.

The connection method allows the load force to be distributed over a greater area due to the increased contact surface area between the connector key 40 and respective receiver tubes. In addition, the vertical orientation of the lock bolt 44 (carriage head bolt) can minimize or eliminate the compression load and brinelling, or deformation associated with connection fasteners, can be greatly minimized or eliminated. The present invention provides a fast, safe, dependable and durable means to connect dock assemblies and can be performed from above the deck.

According to another embodiment, referring to FIGS. 8-12, the dock assembly 10 can include a dock connection adapter 50 configured to be connected to a dock sidewall (e.g., fourth sidewall 32). The connection adapter 50 includes an elongated middle member 52 and two receiver tubes 54 positioned on two ends of the elongated middle member 52. The length of the dock connection adapter 50 can be custom made to match length of certain dock sidewall.

The dock connection adapter 50 and a dock sidewall (e.g., the second dock sidewall 14) can be positioned side by side such that respective vertical tubes 54 of the dock connection adaptor 50 and the respective first and second receiver tubes 16 and 26 are abutting each other. The abutting receiver tubes are securely joined by inserting respective upper and lower connector keys 40 dimensioned to fit into respective sockets of the abutting receiver tubes. Similarly, the two abutting receiver tubes can be further securely joined via a horizontally-positioned alignment pin (not shown) on a side wall of the one of the two abutting receiver tubes and a complimentary opening 30 configured to receive the alignment pin on the other of the two abutting receiver tube includes. Two sections of the dock assembly can be positioned in a "T" shaped, "L" shaped dock configuration or other suitable configurations depending the position of the connection adaptor 50.

Figure 10:
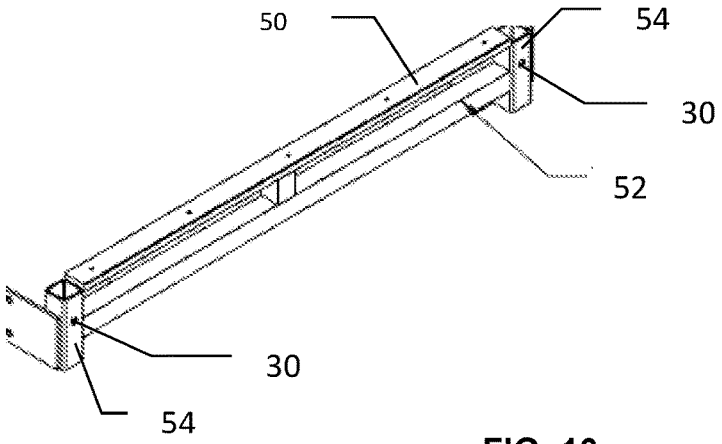
FIG. 10 is a perspective view of a dock connection adapter according to one embodiment of the present invention.
Figure 11:
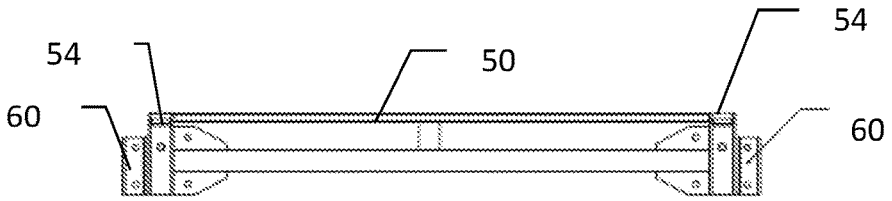
FIG. 11 is a front view of a dock connection adapter according to another embodiment of the present invention.
Figure 12:
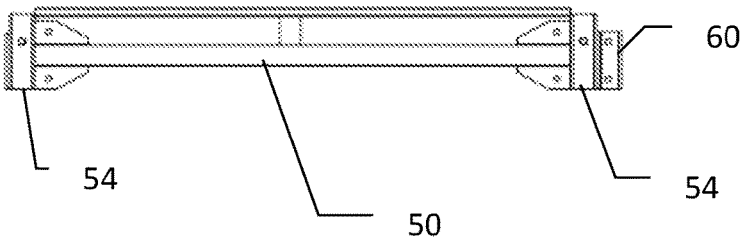
FIG. 12 is a front view a dock connection adapter according to yet another embodiment of the present invention.

The dock connection adapter 50 can be attached on any kinds of dock frames. Moreover, the dock connection adapter 50 can be integrated into the dock frame at the time of manufacture. In the field, the dock connection adapter 50 in the field can also be retrofitted by utilizing a bolt-on version of the adapter 50. As shown in FIGS. 10 and 11, an extra bolting piece 60 is positioned on one or both sides of the receiver tube 54 of the dock connection adapter 50.

Figure 13:
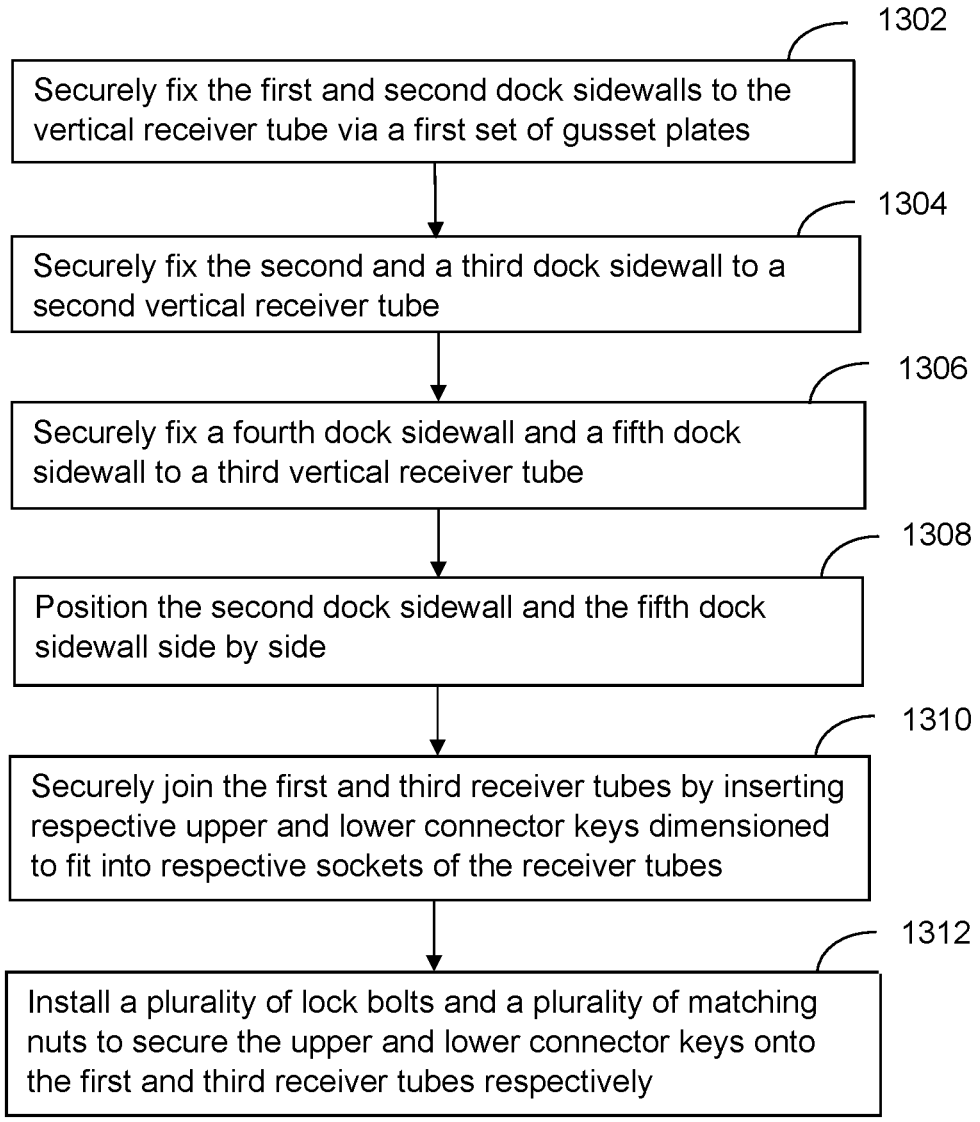
FIG. 13 is a flowchart illustrating a method of assembling a docking system.

Referring to FIG. 13, according to another embodiment of the present invention, a method of assembling a docking system includes, at step 1302, securely fixing (e.g., welding) a first and a second dock sidewall to a first vertical receiver tube. For example, the first vertical receiver tube (e.g., receiver tube 16) is positioned between two adjacent ends of a first dock sidewall 12 and a second sidewall 14. The angle between the first dock sidewall (e.g., first dock sidewall 12) and the second dock sidewall (e.g., second dock sidewall 14) is adjusted to 90 degrees. The first dock sidewall (e.g., first dock sidewall 12) and second dock sidewall (e.g., second dock sidewall 14) are fixed to the first vertical receiver tube (e.g., first vertical receiver tube 16) via a first set gusset plates (e.g., a first set of gusset plates 22). The first dock sidewall and the second dock sidewall each has a peripheral surface (e.g., peripheral surface 18) and a plurality of horizontal surfaces (e.g., horizontal surfaces 20) extending from the peripheral surface, and the first set of gusset plates are fastened (e.g. welded) to the plurality of horizontal surfaces of the first dock sidewalls and the second dock sidewall, for example, to increase weld surface area. These steps construct a first corner of a first dock unit.

At step 1304, the second and a third dock sidewall are securely fixed (e.g., welded) to a second vertical receiver tube. A third dock sidewall (e.g., third dock sidewall 24) is joined at 90 degrees with the second dock sidewall. Similar to the first and second dock sidewalls, the third dock sidewall includes a peripheral surface and a plurality of horizontal surfaces extending from the peripheral surface. A second vertical receiver tube (e.g., second vertical receiver tube 26) is positioned between two adjacent ends of the second dock sidewall and the third dock sidewall. The second and third dock sidewalls are securely fixed (e.g., welded) to the second vertical receiver tube via a second set of gusset plates, for example, to increase weld surface area. This makes a second corner of the first dock unit.

At step 1306, a fourth dock sidewall and a fifth dock sidewall are securely fixed to a third vertical receiver tube. To make a second unit of dock assembly, a third vertical receiver tube (e.g., third receiver tube 36) is positioned between two adjacent ends of a fourth dock sidewall (e.g., fourth dock sidewall 32) and a fifth dock sidewall (e.g., fifth dock sidewall 34). The angle between the fourth dock sidewall and the fifth dock sidewall is adjusted to 90 degrees. The fourth and fifth dock sidewalls are securely fixed to the third vertical receiver tube (e.g., third receiver tube 36) via a third set of gusset plates.

At step 1308, the second dock sidewall and the fifth dock sidewall are positioned side by side such that the first and fourth sidewalls are in alignment and the respective sides of the first and third receiver tubes are abutting each other.

At step 1310, the first and third receiver tubes are securely joined by inserting respective upper and lower connector keys dimensioned to fit into respective sockets of the receiver tubes.

At step 1312, a plurality of lock bolts and a plurality of matching nuts are installed to secure the upper and lower connector keys onto the first and third receiver tubes respectively.

A dock connection adapter (e.g., dock connection adapter 50) can also be used to connect the dock assembly of the present invention to any type of dock frame. For example, the dock connection adapter 50 be attached (e.g., fastened, welded, bolted, etc.) to a dock sidewall. The length of the dock connection adapter 50 can be customized to certain length to match an adjacent connection sidewall. The connection adapter has an elongated middle member and two receiver tubes positioned on two ends of the elongated middle member. The dock connection adapter and a dock sidewall (e.g., second dock sidewall 14) of the present invention can be positioned side by side such that respective vertical tubes of the dock connection adaptor and the respective third and fourth receiver tubes are abutting each other. The abutting receiver tubes can be securely joined by inserting upper and lower connector keys dimensioned to fit into respective sockets of the abutting receiver tubes.

The disclosed dock assembly can be assembled while working from above the dock with two wrenches (e.g. ¾" wrenches) and a dead blow hammer. Galvanic reactivity is eliminated because there is no dissimilar metal contact between the frame and the assembly hardware. The locking fastener does not require routine maintenance or re-tightening. The connection can be easily disassembled later if required. The longevity of the connection can be assured by preventing brinelling.

The dock assembly can be an integral part of the aluminum floating dock construction. The dock assembly can also be used to connect dock accessories such as Kayak decks, lower elevation swim decks, personal watercraft lifts and boat lifts as well as future dock expansion and products.

The foregoing is provided for illustrative and exemplary purposes; the present invention is not necessarily limited thereto. Rather, those skilled in the art will appreciate that various modifications, as well as adaptations to particular circumstances, are possible within the scope of the invention as herein shown and described.

What is claimed is:

1. A dock assembly comprising:

a first dock sidewall and a second dock sidewall joined via a first vertical receiver tube positioned between adjacent ends of the first dock sidewall and the second dock sidewall;

a third dock sidewall joined with the second dock sidewall via a second vertical receiver tube positioned between adjacent ends of the second dock sidewall and the third dock sidewall;

a fourth dock sidewall and a fifth dock sidewall joined via a third vertical receiver tube positioned between adjacent ends of the fourth dock sidewall and the fifth dock sidewall;

wherein the second dock sidewall and the fifth dock sidewall are positioned side by side such that respective sides of the first and third receiver tubes are abutting each other; and wherein the first and third receiver tubes are securely joined by inserting respective upper and lower connector keys dimensioned to fit into respective sockets of the first and third receiver tubes.

2. The dock assembly of claim 1, wherein the first, second, third, fourth and fifth dock sidewalls each includes a peripheral surface and a plurality of horizontal surfaces extending from the peripheral surface, and wherein the first and second dock sidewalls are fixed to the first vertical receiver tube via a first set of gusset plates fastened to the plurality of horizontal surfaces of the first dock sidewall and the second dock sidewall respectively, and wherein the fourth and fifth dock sidewalls are fixed to a third vertical receiver tube via a third set of gusset plates fastened to the plurality of horizontal surfaces of the fourth dock sidewall and the fifth dock sidewall respectively.

3. The dock assembly of claim 1, wherein the first set of gusset plates includes a top gusset plate configured to be positioned at an upper periphery of the first receiver tube.

4. The dock assembly of claim 1, wherein the first set of gusset plates includes a plurality of gusset plates welded to the plurality of horizontal extending planar members on the respective first and second dock sidewalls.

5. The dock assembly of claim 1, wherein the first and second dock sidewalls are made from aluminum.

6. The dock assembly of claim 1, wherein the first receiver tube is hollow with square cross section.

7. The dock assembly of claim 1, wherein the second and third dock sidewall are fixed to the second vertical receiver tube via a second set of gusset plates fastened to the plurality of horizontal surfaces of the second dock sidewall and the third dock sidewall respectively.

8. The dock assembly of claim 1, further comprising a plurality of deck boards positioned in parallel between the first and third dock sidewalls.

9. The dock assembly of claim 1, wherein the fourth and fifth dock sidewalls are fixed to a third vertical receiver tube via a third set of gusset plates fastened to the plurality of horizontal surfaces of the fourth dock sidewall and the fifth dock sidewall respectively.

10. The dock assembly of claim 1, wherein the first and third abutting receiver tubes are further securely joined via a horizontally-positioned alignment pin on a side wall of the first receiver tube and a complimentary opening on the third receiver tube configured to receive the alignment pin.

11. The dock assembly of claim 9, wherein the alignment pin is made of aluminum.

12. The dock assembly of claim 1, further comprising a plurality of lock bolts and a plurality of matching nuts configured to secure the upper and lower connector keys onto the first and third receiver tubes respectively.

13. A dock assembly comprising:

a dock connection adapter configured to be connected to a dock sidewall, and the connection adapter having an elongated middle member and two receiver tubes positioned on two ends of the elongated middle member;

a first dock sidewall joined at a 90 degree angle with a second dock sidewall via a first vertical receiver tube positioned between adjacent ends of the first dock sidewall and the second dock sidewall;

a third dock sidewall joined at a 90 degree angle with the second dock sidewall via a second vertical receiver tube positioned between adjacent ends of the second dock sidewall and the third dock sidewall;

wherein the first dock sidewall, the second dock sidewall and the third dock sidewall each includes a peripheral surface and a plurality of horizontal surfaces extending from the peripheral surface; and wherein the first and second dock sidewalls are fixed to the first vertical receiver tube via a first set of horizontals gusset plates fastened to the plurality of horizontal surfaces of the first dock sidewall and the second dock sidewall respectively;

wherein the second and third dock sidewall are fixed to the second vertical receiver tube via a second set of gusset plates fastened to the plurality of horizontal surfaces of the second dock sidewall and the third dock sidewall respectively;

wherein the dock connection adaptor and the second dock sidewall are positioned side by side such that the respective vertical tubes of the dock connection adaptor and the respective first and second receiver tubes are abutting each other; and wherein the abutting receiver tubes are securely joined by inserting respective upper and lower connector keys dimensioned to fit into respective sockets of the abutting receiver tubes.

14. A method of constructing a docking assembly comprising:

securely fixing a first and a second dock sidewall to a first vertical receiver tube;

securely fixing the second and a third dock sidewall to a second vertical receiver tube;

securely fixing a fourth dock sidewall and a fifth dock sidewall to a third vertical receiver tube;

positioning the second dock sidewall and the fifth dock sidewall side by side such that the first and fourth sidewalls are in alignment and the respective sides of the first and third receiver tubes are abutting each other;

securely joining the first and third receiver tubes by inserting respective upper and lower connector keys dimensioned to fit into respective sockets of the receiver tubes; and installing a plurality of lock bolts and a plurality of matching nuts to secure the upper and lower connector keys onto the first and third receiver tubes respectively.

15. The method of claim 14, wherein the first and second dock sidewalls are securely fixed to the first vertical receiver tube via a first set of gusset plates, wherein the second and third dock sidewalls are securely fixed to the second receiver tube via a second set of gusset plates, wherein the fourth sidewall and the fifth sidewall are securely fixed to the third vertical receiver tube via a third plurality of gusset plates.

16. The method of claim 15, wherein the first, second, third, fourth and fifth dock sidewall each has a peripheral surface and a plurality of horizontal surfaces extending from the peripheral surface, and the first set of gusset plates are fastened to the plurality of horizontal surfaces of the first dock sidewall and the second dock sidewall.

17. The method of claim 14, wherein securely fixing a first and a second dock sidewall to a first vertical receiver tube includes welding the first and second dock sidewalls to the first vertical receiver tube, securely fixing the second and a third dock sidewall to a second vertical receiver tube includes welding the second and a third dock sidewall to a second vertical receiver tube, and securely fixing a fourth dock sidewall and a fifth dock sidewall to the third vertical receiver tube includes welding the second and a third dock sidewall to a second vertical receiver tube.

18. The method of claim 16, further comprising:

positioning a plurality of deck boards positioned in parallel between the first and third dock sidewalls.

19. The method of claim 16, further comprising:

connecting a dock connection adapter to the first dock sidewall, the connection adapter having an elongated middle member and two receiver tubes positioned on two ends of the elongated middle member.

20. The method of claim 19, further comprising connecting a dock sidewall to the dock connection adaptor.

* * * * *